US006848915B1

(12) United States Patent
Perhats, Sr.

(10) Patent No.: US 6,848,915 B1
(45) Date of Patent: Feb. 1, 2005

(54) CONNECTING CIRCUITS FOR PRE-EXISTING VEHICLE RELAYS

(76) Inventor: Frank J. Perhats, Sr., 607 Old Barn Rd., Lake Barrington, IL (US) 60010-6211

( * ) Notice: Subject to any disclaimer, the term of this patent is extended or adjusted under 35 U.S.C. 154(b) by 0 days.

(21) Appl. No.: 10/615,536

(22) Filed: Jul. 8, 2003

(51) Int. Cl.[7] ..... H01R 12/00
(52) U.S. Cl. ..... 439/76.2
(58) Field of Search ..... 439/76.2, 860, 439/949, 392, 34

(56) References Cited

U.S. PATENT DOCUMENTS 4,679,881 A * 7/1987 Galvin et al. ..... 439/392
5,722,851 A * 3/1998 Onizuka et al. ..... 439/404
6,488,551 B1 * 12/2002 Tomlin et al. ..... 439/860
2002/0163783 A1 * 11/2002 Ashiya et al. ..... 361/719
2003/0017727 A1 * 1/2003 Seo et al. ..... 439/76.2

* cited by examiner

*Primary Examiner*—J. F. Duverne
(74) *Attorney, Agent, or Firm*—Cook, Alex, McFarron, Manzo, Cummings & Mehler, Ltd.

(57) ABSTRACT

A relay connecting means comprising a loose terminal connector mounted on a thin substrate carrier. The loose terminal connector comprising displaceable tabs being engagable with the terminal blade of the automotive plug-in relay. The loose terminal connector may further comprise a wire connecting post for connecting a wire conductor thereto.

13 Claims, 2 Drawing Sheets

CONNECTING CIRCUITS FOR PRE-EXISTING VEHICLE RELAYS

BACKGROUND OF THE INVENTION

The present invention relates to vehicle relays generally, and more specifically, to means for connecting circuits to pre-existing vehicle relays.

Many automotive aftermarket products require connections to pre-existing vehicle circuitry. Frequently, these connections can be made at various points in the vehicle circuitry by readily available pre-existing connecting means such as tap or butt connectors. Those skilled in the art will recognize that some aftermarket products require that the preexisting vehicle circuitry electrically drive the aftermarket product circuitry in order to function.

One common method to connect the aftermarket product circuitry to the pre-existing vehicle circuitry is at the relay that controls or switches the desired function in the pre-existing vehicle circuitry. Examples of these relays located in pre-existing vehicle circuitry and common in this field include the plugable MINI or MICRO relay.

Automotive relays are usually located in terminal boxes along with other circuit components such as fuses and circuit breakers. One recognized problem in connecting aftermarket product circuitry to the pre-existing vehicle circuitry is that the spaces within the terminal box can be confined, thereby making good electrical connections rather difficult and time consuming. Those skilled in the art will appreciate that tapping circuits at relay terminals is faster than at specific wires often contained within a complex bundle of wires.

Those skilled in the art will further recognize that the thickness of prior art relay connecting means prevents full engagement of the relay terminals with the female terminals in the receptacle, thereby resulting in poor, failure prone connections. This undesirable thickness further causes the relay to protrude from the receptacle to the point that the terminal box cover cannot be re-closed, thereby allowing the entry of dust and other contaminants.

In view of the foregoing, it is desirable to develop a means for quickly connecting circuits to pre-existing vehicle circuitry via relay terminals of pre-existing vehicle circuitry, such as the inch cube MINI or MICRO relay or any possible future plugable relay design, including but not limited to those relays which meet world International Standards Organization standards in size, terminal layout, and terminal function location.

It is further desirable to develop a versatile means for connecting circuits to pre-existing vehicle relays that is capable of connection to a specific terminal of any given relay size and type or one designed to tap any relay terminal chosen by the installer depending on his need at installation.

It is further desirable to develop a means for connecting circuits to pre-existing vehicle circuitry with a thickness that allows for full engagement of the relay terminals with the female terminals in the receptacle and reclosure of the terminal box cover.

These and other desired benefits of the preferred forms of the invention will become apparent from the following description. It will be understood, however, that a device could still appropriate the claimed invention without accomplishing each and every one of these desired benefits, including those gleaned from the following description. The appended claims, not these desired benefits, define the subject matter of the invention. Any and all benefits are derived from the preferred forms of the invention, not necessarily the invention in general.

SUMMARY OF THE INVENTION

The present invention is directed to a means for connecting circuits to pre-existing vehicle relays. The present invention provides means for connecting to any of the four or five terminals of standard plug-in automotive relays. The relay connecting means comprises a loose terminal connector mounted on a thin substrate carrier. The loose terminal connector comprising displaceable tabs being engageable with the terminal blade of the automotive plug-in relay. The loose terminal connector may further comprise a wire connecting means for connecting a wire conductor thereto.

BRIEF DESCRIPTION OF THE DRAWINGS

Throughout this description, reference will be made to the accompanying views of the drawing wherein like subject matter has like reference numerals, and wherein.

DETAILED DESCRIPTION OF THE INVENTION

Figure 4:
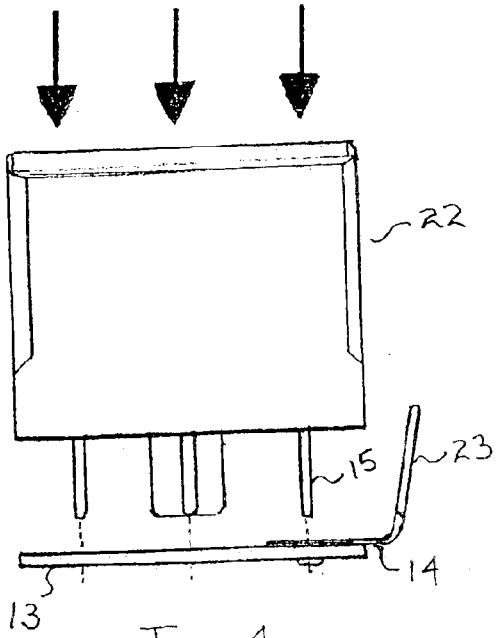
FIG. 4 is an exploded side view of a first embodiment of the relay connecting means, wherein the first embodiment loose terminal connector of FIG. 1 is carried by the first embodiment thin substrate carrier of FIG. 2, wherein the displaceable tabs of the loose terminal connector are engagable with a relay terminal blade.
Figure 1:
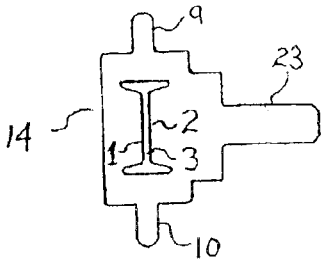
FIG. 1 is a plan view of a first embodiment of a loose terminal connector comprising displaceable tabs engagable with a relay terminal blade and a wire connecting means engagable with a wire conductor.

FIG. 1 illustrates a plan view of one possible embodiment of a loose terminal connector 14 fabricated by metal stamping or metal etching. The loose terminal connector 14 comprises a generally rectangular body including two displaceable tabs 1 and 2 separated for a predetermined length, thereby defining a displaceable tab slot 3. The separation between the tabs 1 and 2 is less than the thickness of the terminal blade 15 of relay 22 (FIG. 4). Accordingly, when the blade is inserted into the slot 3 the tabs will engage the terminal blade.

Figure 2:
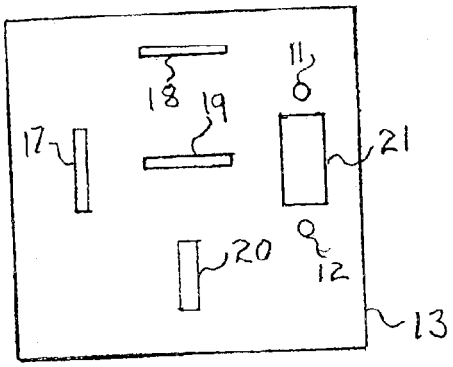
FIG. 2 is a plan view of a first embodiment of a thin substrate carrier adapted to carry the loose terminal connector of FIG. 1.

FIG. 2 illustrates a substrate carrier 13 adapted to retain the loose terminal connector 14 of FIG. 1. Substrate carrier 13 defines retention holes 11 and 12. Retention tabs 9 and 10 of the loose terminal connector 14 are engagable with the retention holes 11 and 12. Specifically, retention tabs 9 and 10 are bent 90° and placed within retention holes 111 and 12, respectively. Thereafter retention tabs 9 and 10 are then further bent again so that the retention tabs engage with underside of the substrate carrier 13. It is important to note that retention tabs 9 and 10 may alternatively be cut off and discarded if the loose terminal connector 14 is to be used in a freestanding manner.

Substrate carrier 13 further defines displaced tab retention slot 21, which accommodates the displaced tabs 1 and 2 upon insertion of a relay terminal blade 15 as depicted in FIG. 4. Substrate carrier 13 further defines relay terminal blade guiding slots 17, 18, 19, and 20, which guide the remaining relay 22 terminal blades, which may or may not be connected thereto.

Figure 3:
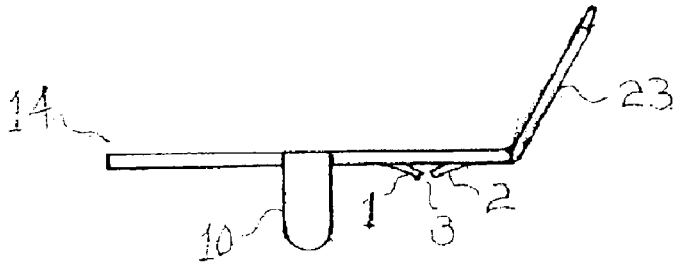
FIG. 3 is a side view of the first embodiment loose terminal connector of FIG. 1, specifically depicting the resultant displacement of displaced tabs from the plane of the rest of the loose terminal connector.

FIG. 3 is a side view of the first embodiment loose terminal connector 14 of FIG. 1. FIG. 3 specifically depicts the displacement of tabs 1 and 2 from the plane of the rest of the loose terminal connector 14, which would be caused by the insertion of the terminal blade 15 through the slot 3. This displacement causes a wedging action between the edges of the displaced tabs 1 and 2 and the terminal blade 15 of the inserted relay 22. In order to facilitate engagement of the terminal blade 15 and the displaced tabs 1 and 2, the width of the tab slot 3 is less than the thickness of the terminal blade 15. Those skilled in the art will appreciate that this arrangement provides for a strong grip on inserted terminal blade 15 against withdrawal by vibration or even by manual means. It will further be appreciated that this arrangement contributes to the maintaining of a good electrical connection especially when relay 22 and terminal blade 15 are re-plugged into their original relay receptacle.

Figure 5:
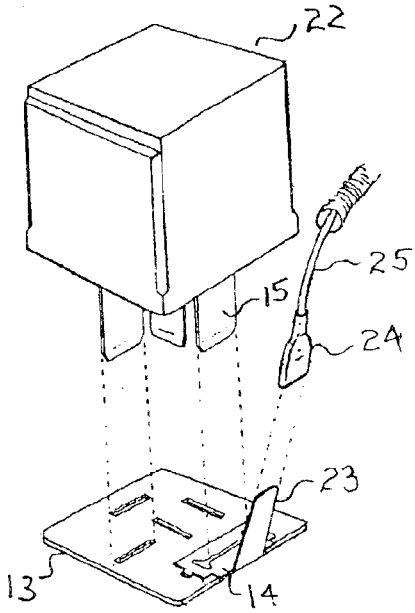
FIG. 5 is an exploded perspective view of the first embodiment relay connecting means of FIG. 3, further depicting the wire connecting means being engagable with a wire conductor.

FIG. 5 is an exploded perspective view of a first embodiment of the relay connecting post, wherein relay terminal blade 15 engages with the loose terminal connector 14 carried by the substrate carrier 13. Loose terminal connector 14 further comprises wire connecting post 23, which may be adapted to engage with a wire conductor 24. In this embodiment, the wire connecting post 23 is in the form of a wire connecting tab, which is engagable with the wire conductor 24 which is in the form of a female quick connect terminal. Those skilled in the art will appreciate that this wire connecting post 23 provides means for connecting a second electrical wire 25 to the relay terminal 15. It is important to note that this arrangement represents only one of many possible means of making an electrical connection to the wire connecting post 23.

Figure 6:
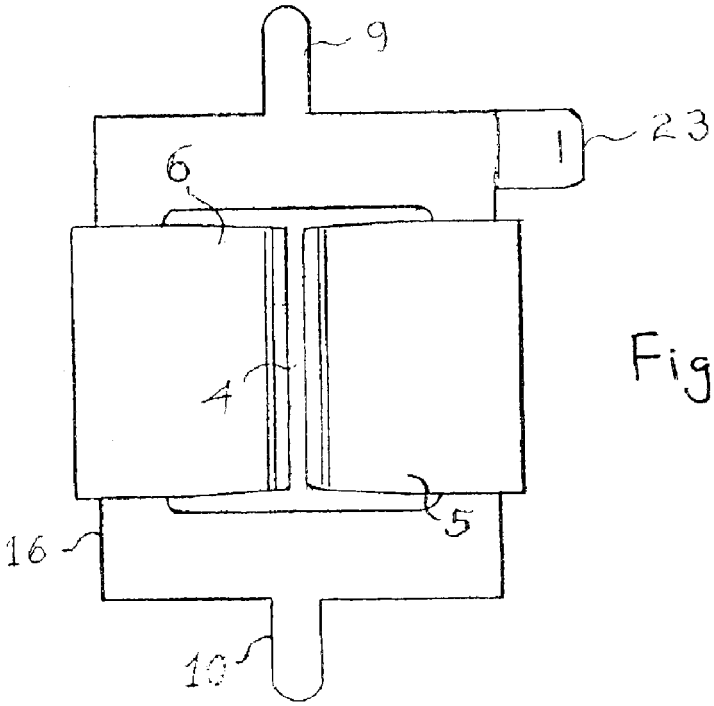
FIG. 6 is a plan view of a second embodiment loose terminal connector comprising displaceable tabs engagable with a relay terminal blade and a wire connecting means engagable with a wire conductor.

FIG. 6 depicts a second embodiment loose terminal connector 16 comprising folding displaceable tabs 5 and 6 engagable with a relay terminal blade 15 and a second embodiment of a electrical connection post 23*b* engagable with a wire conductor 24. The displaceable tabs in this embodiment are in the form of folding displaceable tabs 5 and 6, which define a folding tab slot 4. The width of this folding tab slot 4 is smaller than the thickness of the terminal blade 15. Those skilled in the art will appreciate that this arrangement further provides for a strong grip on inserted terminal blade 15 against withdrawal by vibration or even by manual means. It will further be appreciated that this arrangement contributes to the maintaining of a good electrical connection especially when relay and blade are re-plugged into their original relay receptacle.

The second embodiment loose terminal connector 16 further comprises mounting tabs 9*b* and 10*b* for attachment to substrate carrier 13. These mounting tabs are similar in form and function to retention tabs 9 and 10 of the first embodiment. It will further be appreciated that this loose terminal connector 16 further comprises an electrical connection post 23*b*, which is similar in form and function to the wire connection post 23 of the first embodiment.

Figure 7:
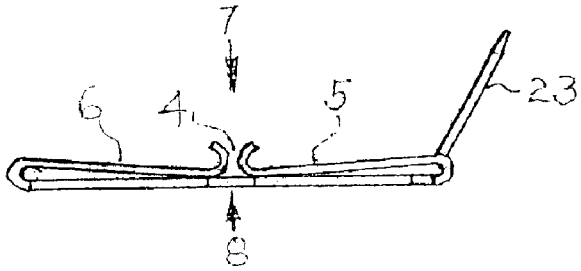
FIG. 7 is a side view of the second embodiment loose terminal connector of FIG. 6.

FIG. 7 is a side view of the second embodiment loose terminal connector of FIG. 6. Curling the edges of the folding displaceable tabs 5 and 6 will cause the folding displaceable tabs 5 and 6 to flex and thereupon accommodate varying relay 22 terminal blade 15 thicknesses inserted therein. This springlike flexure of the folding displaceable tabs 5 and 6 provides continual pressure on the terminal blade 15 to assure continued good electrical contact. It will further be appreciated that the folding tab curls 26 and 27 provide easy insertion of relay 22 terminal blade 15. It is important to note that the folding tab curls 26 and 27 are optional in this design.

In this second embodiment, the difficulty in retention and withdrawal of the terminal blade 15 is dependant upon from which side relay 22 terminal blade 15 is inserted. Insertion of relay 22 terminal blade 15 into folding tab slot 4 between folding tabs 5 and 6 of connector 16 from side 7 will be more difficult. This is due to the fact that the act of insertion tends to force folding tabs 5 and 6 together. Conversely, withdrawal will be easier because folding tabs 5 and 6 will flex with the withdrawing force, thereby opening folding tab slot 4.

On the other hand, insertion of terminal blade 15 into folding tab slot 4 between folding tabs 5 and 6 from side 8 of loose terminal connector 16 will be comparatively easy because the act of insertion flexes folding tabs 5 and 6 in the direction of insertion, thereby opening folding tab slot 4. Conversely, withdrawal will be more difficult when terminal blade 15 is withdrawn from insertion from direction 8 because the withdrawing force tends to close folding tab slot 4 between folding tabs 5 and 6.

The two connector designs shown, are contemplated to represent just a few of many variants possible that provide the connection characteristics depicted by this invention including thinness permitting essentially full relay re-engagement with original relay socket, free standing use or use mounted on a substrate carrier as chosen by the installer at time of installation or, already mounted to a carrier substrate, at time of manufacture, by any common means such as that depicted or other means such as molded in place, sonically, heat, solvent or adhesive welded, riveted or by any other known or future developed means and so designed as to be able to connect to any relay terminal, singly or in multiple combinations, at one time.

While this invention has been described with reference to certain illustrative aspects, it will be understood that this description shall not be construed in a limiting sense. Rather, various changes and modifications can be made to the illustrative embodiments without departing from the true spirit and scope of the invention, as defined by the following claims. Furthermore, it will be appreciated that any such changes and modifications will be recognized by those skilled in the art as an equivalent to one or more elements of the following claims, and shall be covered by such claims to the fullest extent permitted by law. For example, while the invention has been described in connection with automotive applications, it will be realized that the connector could readily be adapted for other environments as well.

I claim:

1. A terminal connector for connecting electrical circuits to a pre-existing relay, the relay including a terminal blade, the connector comprising:

a generally planar body, and first and second displaceable tabs formed in the planar body and moveable out of the plane of the body upon insertion of the terminal blade, said first and second displaceable tabs being spaced apart to define a tab slot therebetween, the tab slot being adapted for receiving the terminal blade of the relay, whereupon the tabs engage the terminal blade.

2. The terminal connector of claim 1 wherein the planar body further comprises a wire connecting post adapted to engage a wire conductor.

3. The terminal connector of claim 1 wherein the width of the tab slot is less than the thickness of the terminal blade.

4. The terminal connector of claim 1 wherein the first and second displaceable tabs are first and second folding tabs, said folding tabs being formed by folding a portion of the planar body back onto itself.

5. The terminal connector as defined by claim 4 wherein the first and second folding tabs each include a first end carried by the body and a second curled end.

6. A connector for electrically connecting circuits to a pre-existing relay, the relay including a terminal blade, the connector comprising:

a terminal connector including a generally planar body, first and second retention tabs, first and second displaceable tabs formed in the planar body, said first and second displaceable tabs being spaced apart to define a tab slot therebetween, the tab slot being adapted for receiving the terminal blade of the relay, whereupon the tabs will engage the terminal blade; and a substrate carrier engageable with the terminal connector and defining first and second retention holes, said retention holes being adapted to receive and retain the retention tabs of the terminal connector.

7. The connector of claim 6 wherein the width of the tab slot of said terminal connector is less than the thickness of the terminal blade.

8. The connector of claim 6 wherein said substrate carrier further defines a displaced tab retention slot adapted to receive and accommodate the first and second displaceable tabs of the terminal connector.

9. The connector of claim 6 wherein said substrate carrier further defines a guiding slot adapted to slidably receive and guide the terminal blade of the relay.

10. The connector of claim 6 wherein the body of the terminal connector further comprises a wire connecting post adapted for engagement with a wire conductor.

11. The connector of claim 6 wherein the first and second displaceable tabs are first and second folding tabs, said folding tabs being formed by folding a portion of the planar body back onto itself.

12. The connector of claim 11 wherein the first and second folding tabs each include a first end carried by the body of the terminal connector and a second curled end.

13. The terminal connector of claim 1 wherein the first and second displaceable tabs have a width at least as great as that of the terminal blade.

* * * * *